US008189836B2

(12) United States Patent
Ho et al.

(10) Patent No.: US 8,189,836 B2
(45) Date of Patent: May 29, 2012

(54) EAR MOLD WITH VENT OPENING THROUGH OUTER EAR AND CORRESPONDING VENTILATION METHOD

(75) Inventors: Wai Kit David Ho, Singapore (SG); Wee Haw Koo, Singapore (SG)

(73) Assignee: Siemens Medical Instruments Pte. Ltd., Singapore (SG)

( * ) Notice: Subject to any disclaimer, the term of this patent is extended or adjusted under 35 U.S.C. 154(b) by 858 days.

(21) Appl. No.: 12/286,670

(22) Filed: Oct. 1, 2008
(Under 37 CFR 1.47)

(65) Prior Publication Data

US 2009/0123011 A1 May 14, 2009

(30) Foreign Application Priority Data

Oct. 1, 2007 (DE) ..... 10 2007 046 998

(51) Int. Cl.
*H04R 25/00* (2006.01)

(52) U.S. Cl. ..... 381/318; 381/328

(58) Field of Classification Search ..... 381/318, 381/328
See application file for complete search history.

(56) References Cited

U.S. PATENT DOCUMENTS 5,357,576 A * 10/1994 Arndt ..... 381/328
2008/0279405 A1 * 11/2008 Isogi et al. ..... 381/329

FOREIGN PATENT DOCUMENTS

DE 10200600804 B3 5/2007
WO WO 2007077605 A1 * 7/2007

* cited by examiner

*Primary Examiner* — Tu-Tu Ho

(57) ABSTRACT

A method and hearing aid mold are provided for a hearing device with a first segment for insertion into the auditory canal of the user, a second segment, which projects into the concha of the user when inserted, and a vent, which runs from the first segment into the second segment. A vent opening, which may be enclosed by a titanium ring, is directed in the second segment toward the outer ear of the user, so that an exchange of air can be achieved between the auditory canal and the rear of the outer ear through an opening in the outer ear. Ventilation of the auditory canal from the rear of the outer ear reduces the risk of feedback.

5 Claims, 2 Drawing Sheets

EAR MOLD WITH VENT OPENING THROUGH OUTER EAR AND CORRESPONDING VENTILATION METHOD

CROSS REFERENCE TO RELATED APPLICATIONS

This application claims priority of German application No. 10 2007 046 998.7 DE filed Oct. 1, 2007, which is incorporated by reference herein in its entirety.

FIELD OF INVENTION

The present invention relates to an ear mold for a hearing device with a first segment for insertion into the auditory canal of a user, a second segment, which projects into the concha of the user when inserted, and a vent, which runs from the first segment into the second segment. The present invention also relates to a method for reducing feedback by ventilating an auditory canal of a user. The term "hearing device" here refers in particular to a hearing aid and also any other sound-emitting device that can be worn on the ear, such as a headset, headphones, etc.

BACKGROUND OF INVENTION

Hearing aids are hearing devices that can be worn and which are used to assist those with impaired hearing. Different types of hearing aids, such as behind-the-ear (BTE) hearing aids, hearing aids with an external receiver (RIC: receiver in the canal) and in-the-ear (ITE) hearing aids, e.g. also concha hearing aids or completely in the canal hearing aids (ITE, CIC), are available to meet the numerous individual needs. The hearing aids listed by way of example are worn on the outside of the ear or in the auditory canal. Bone conduction hearing aids and implantable or vibrotactile hearing aids are also commercially available. With these the impaired hearing is stimulated either mechanically or electrically.

The essential components of a hearing aid are in principle an input transducer, an amplifier and an output transducer. The input transducer is generally a sound receiver, e.g. a microphone, and/or an electromagnetic receiver, e.g. an induction coil. The output transducer is generally in the form of an electroacoustic transducer, e.g. a miniature loudspeaker, or as an electromechanical transducer, e.g. a bone conduction earpiece. The amplifier is generally incorporated in a signal processing unit. This basic structure is shown in FIG. 1 using the example of a behind-the-ear hearing aid. One or more microphones 2 for receiving ambient sound are incorporated in a hearing aid housing 1 to be worn behind the ear. A signal processing unit 3, which is likewise incorporated in the hearing aid housing 1, processes and amplifies the microphone signals. The output signal of the signal processing unit 3 is transmitted to a loudspeaker or earpiece 4, which outputs an acoustic signal. In some instances the sound is transmitted by way of a sound tube, which is fixed in the auditory canal with an otoplastic, to the eardrum of the hearing aid wearer. Power is supplied to the hearing aid and in particular to the signal processing unit 3 by way of a battery 5 likewise incorporated in the hearing aid housing 1.

SUMMARY OF INVENTION

BTE hearing aids with a large vent or even so-called open BTE hearing aids can be used for slight hearing losses. With the open BTE hearing aids the auditory canal is not completely closed off by an ear mold but a sound tube or an external earpiece is simply held in the auditory canal by an ear mold. A constant exchange of air is therefore possible between the external environment and the auditory canal, so the wearing sensation is not uncomfortable and the auditory canal does not become diseased. Hearing aids with a large vent also ensure an adequate exchange of air, even though an ear mold is used, which is individually molded to the auditory canal.

A sealed ear mold or sealed ear shell has to be used to reduce feedback in cases of average and more severe hearing loss. For sensitive ears this means that more ear wax is produced, resulting in disease or diminished wearing comfort.

A hearing aid with a ventilation channel that can be worn in the ear is known from the published patent DE 10 2006 008 044 B3. Barometric pressure equalization is to be established in a sound channel between an earpiece and a cerumen protection facility with a gas-tight membrane. To this end a pressure equalization channel is provided, which opens into the sound channel. The pressure equalization channel connects the sound channel to a ventilation channel (vent).

The object of the present invention is therefore to achieve better ventilation of the auditory canal precisely for hearing devices with high amplification.

According to the invention this object is achieved by an ear mold for a hearing device with a first segment for insertion into the auditory canal of a user, a second segment, which projects into the concha of the user when inserted, and a vent, which runs from the first segment into the second segment, a vent opening in the second segment being directed toward the outer ear of the user, so that an exchange of air can be achieved between the auditory canal and the rear of the outer ear through an opening in the outer ear.

According to the invention provision is also made for a method for reducing feedback by ventilating an auditory canal of a user as claimed in the independent claims, an ear mold of a hearing device being inserted into the auditory canal, by providing a vent through the ear mold, providing an opening through the outer ear of the user from the front to the rear of the outer ear, connecting the vent to the opening in the outer ear and ventilating the auditory canal with air guided through the outer ear directly from the rear of the outer ear.

It is therefore advantageously possible to ventilate the auditory canal directly from the rear of the outer ear, so that sound passing outward through the vent opening first has to pass around the outer ear or travel a longer distance behind the ear before it can contribute significantly to feedback.

The ear mold is preferably configured as a shell of an ITE hearing aid or a concha hearing aid. With such types of hearing aid specifically individually molded hearing aid shells are used, for which the problem of inadequate ventilation of the auditory canal constantly occurs with higher amplifications.

The ear mold can optionally also be used as a support for a hearing tube or an external microphone of a BTE hearing aid. It is then favorable if the vent opening is directed more downward when the hearing device is worn, as the microphones of a BTE hearing aid can generally be found on the top of the hearing aid. Therefore the sound from the vent must make quite a long detour behind the ear, before it gets back to the microphone(s) of the BTE hearing aid.

According to a particularly preferred embodiment the vent opening in the second segment of the ear mold, which projects into the concha of the user when inserted, is enclosed by a titanium ring. Titanium is known to be a biocompatible material, so problems with a surgically created opening in the outer ear are least likely to be encountered. Of course other biocompatible materials can also be used to enclose the vent opening.

The titanium ring or the ring made of biocompatible material can project from the surface of the ear mold. In this instance the ring can be inserted directly into the opening in the outer ear, without any risk of the vent being closed off by the outer ear due to displacement of the ear mold.

BRIEF DESCRIPTION OF THE DRAWINGS

The present invention is described in more detail below with reference to the accompanying drawings, in which.

DETAILED DESCRIPTION OF INVENTION

The exemplary embodiment described in more detail below represents a preferred embodiment of the present invention.

Figure 1:
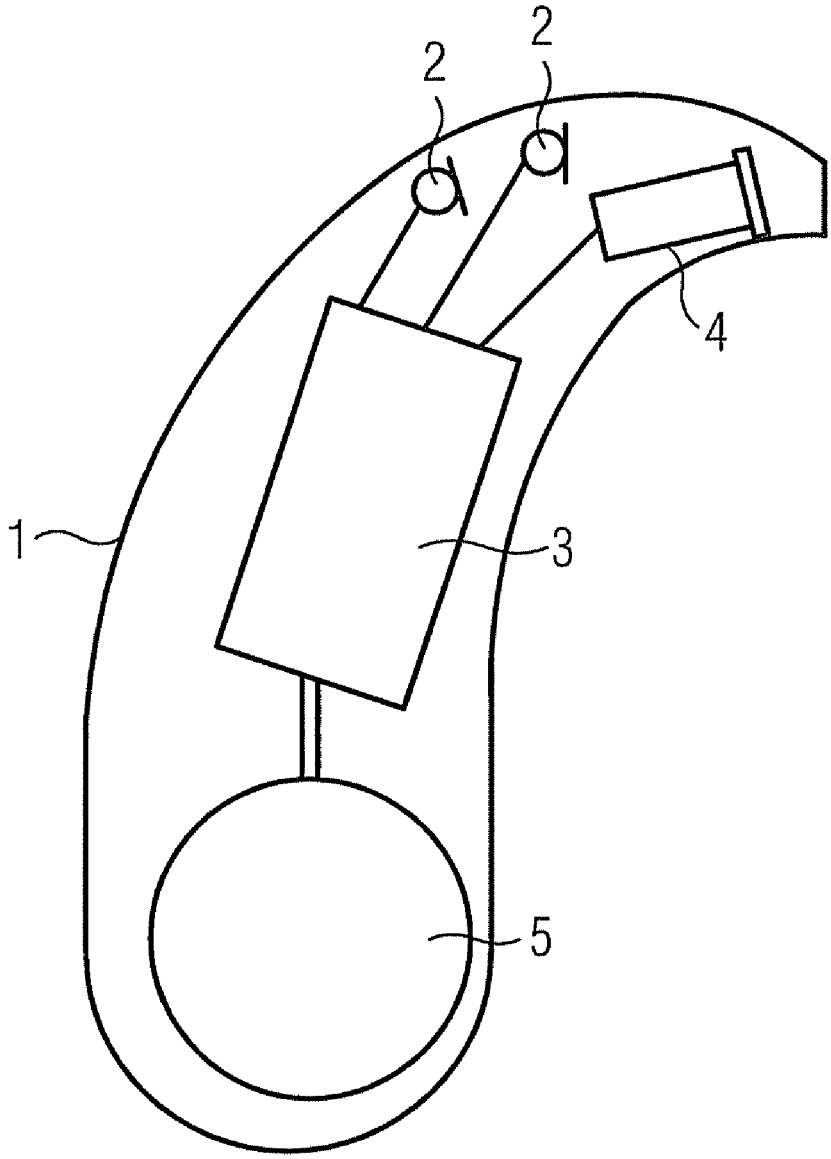
FIG 1 (Prior art)
FIG. 1 shows the basic structure of a hearing aid according to the prior art.
Figure 2:
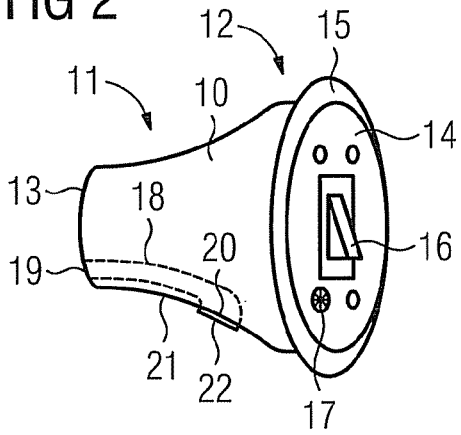
FIG. 2 shows a side view of an inventive ITE hearing aid.

The ear mold according to the example in FIG. 2 represents a hearing aid shell 10 of an ITE hearing aid. The hearing aid shell 10 has a roughly truncated cone shape, with the narrower part 11 being inserted into the auditory canal of the hearing aid wearer, while the wider part 12 projects out of the auditory canal into the concha of the outer ear of the hearing aid wearer. The end face of the hearing aid shell 10, which faces the ear drum when inserted and terminates the narrower part 11, can be referred to as the inside 13. The opposite outside 14 terminates the wider part 12 of the hearing aid shell 10. The outside 14 is enclosed by a sealing ring 14 made of soft material. It has the task of sealing the ITE hearing aid, when inserted, acoustically from the inside, so that as little sound as possible can penetrate outward between the hearing aid shell 10 and the wall of the auditory canal. A switch 16 and microphone 17 for example can be arranged on the outside 14.

A vent 18 runs in the interior of the hearing aid shell 10 from the inside 13 to the wider segment 12, which projects into the concha of the outer ear. It does not extend to the outside 14 but exits on the lateral surface of the truncated cone shaped hearing aid shell 10, which is in contact with the concha. This means that the vent 18 runs in an essentially L-shape and has an opening 19 on the inside 13 and an outlet 20 on the lateral surface 21. This outlet 20 therefore represents the second vent opening and is enclosed by a titanium ring 22. This titanium ring 22 projects to some degree from the lateral surface 21 or the surface of the hearing aid shell 10.

Figure 3:
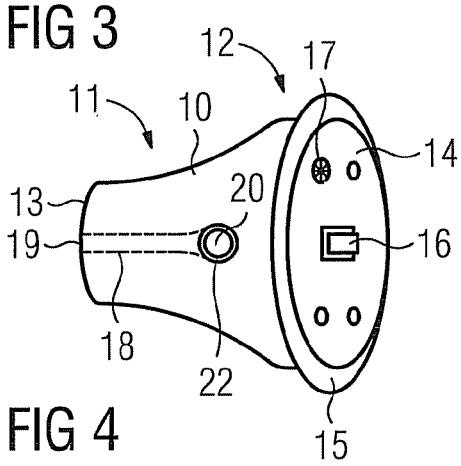
FIG. 3 shows the ITE hearing aid from FIG. 2 viewed from below.

FIG. 3 shows the ITE hearing aid from FIG. 2 viewed from below. It clearly shows that the vent 18 starts with its first vent opening 19 from the inside 13, i.e. from the tip of the ear mold, and ends roughly in the center of the body of the hearing aid shell in the second vent opening 20. This vent opening is enclosed by the titanium ring 22.

Figure 4:
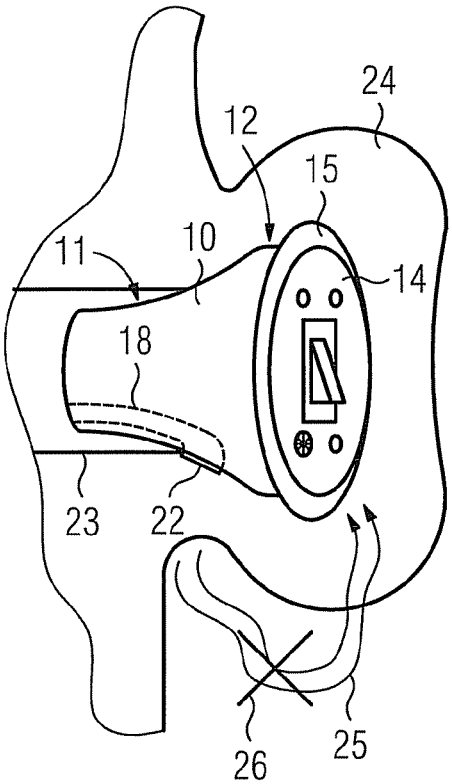
FIG. 4 shows a view of the ITE hearing aid from FIG. 2 when worn from the front of the user.

FIG. 4 shows the ITE hearing aid from FIGS. 2 and 3 when inserted into the ear of a user from the front of the user. The tip, i.e. the narrow part 11, of the hearing aid projects into the auditory canal 23 of the user. The wider part 12 of the hearing aid shell 10 projects into the concha of the outer ear 24. A circular opening 27 has been surgically created in this outer ear 24 (see also FIG. 6). The titanium ring 22 projects into this opening 27. The sound, which is generated in the auditory canal 23 and can pass outward through the vent 18, is therefore directed through the titanium ring 22 or the opening 27 in the outer ear 24 behind the outer ear 24. Only the fraction of the sound from the vent, which makes the detour around the outer ear 24 (see arrows 25 in FIG. 4) contributes to feedback. This detour around the outer ear 24 to the microphone 17 of the hearing aid results in a significant reduction in feedback, as shown in FIG. 4 by the cross 26.

Figure 5:
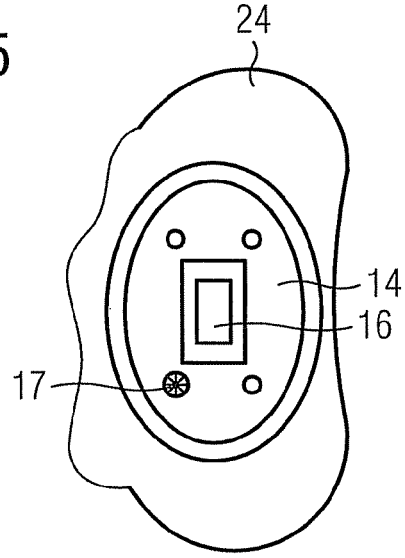
FIG. 5 shows the view of the ITE hearing aid from FIG. 4 from the side of the user and FIG. 6 shows a view of the ear of the user from the rear.

FIG. 5 shows the outer ear 24 of the user with the hearing aid inserted from the side, simply for an additional view. In this view it is only possible to see the outside 14 and the switch 16 and microphone 17. Depending on the nature of the sealing ring 15, which is intended to prevent acoustic loss from the lateral vent opening 20 to the microphone 17 along the hearing aid housing 10, this sealing ring 15 should be visible in the side view. In the present example it is set back to some degree behind the outside 14 and therefore cannot be seen.

Figure 6:
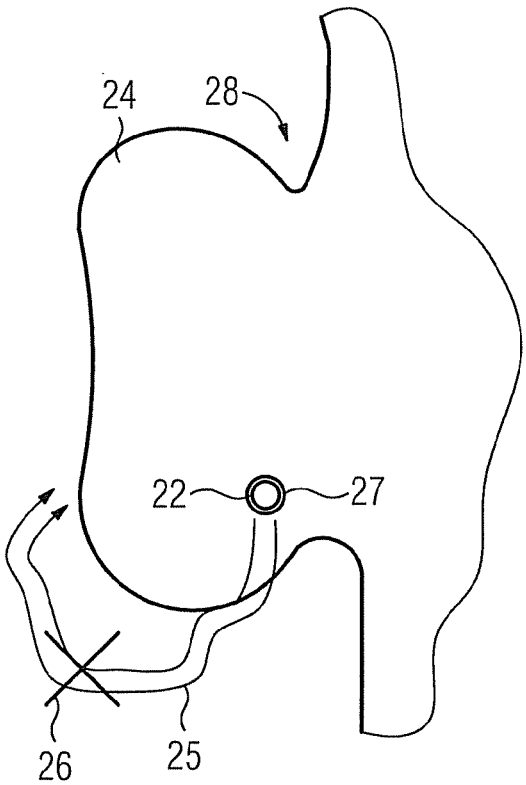

FIG. 6 finally shows a view from the rear of the outer ear 24. This view shows the opening 27 created surgically in the outer ear 24 and the titanium ring 22 passed through it. That feedback sound from the vent 18 cannot pass along the hearing aid shell 10 to the microphone 17 without further ado is largely prevented by both the sealing ring 15 and the above-mentioned titanium ring 22 (see also FIG. 4). The sound penetrating outward through the vent is therefore directed behind the outer ear 24, as shown by the arrows 25 in FIG. 6. As already mentioned in relation to FIG. 4, the detour for the sound around the outer ear 24 is so great that its volume decreases significantly (see cross 26), so that the corresponding feedback factor is also significantly reduced.

Even if the inventive technology of the vent 18 extending laterally out of the mold is also used for BTE hearing aids, the sound, which passes outward through the vent 18, must also pass from the outer ear opening 27 or the titanium ring 22 along the rear of the outer ear to the top of the outer ear 28, where the microphones of a BTE hearing aid are generally arranged. This path is also relatively long, so that the feedback factor is also reduced for BTE hearing aids.

The invention claimed is:

1. A hearing aid mold for a hearing device, comprising:

a first segment for insertion into an auditory canal of a user;

a second segment, which projects into a concha of the user when inserted;

a vent that extends from the first segment into the second segment; and a vent opening in the second segment, the vent opening is directed toward the outer ear of the user such that an exchange of air achievable between the auditory canal and the rear of the outer ear through an opening in the outer ear, wherein the vent opening is enclosed by a titanium ring, and wherein the mold is configured as a shell of an in-the-ear hearing aid or a concha hearing aid.

2. The hearing aid mold as claimed in claim 1, wherein the titanium ring projects from the surface of the ear mold.

3. A method for reducing feedback of a hearing device by ventilating an auditory canal of a user, the ear mold of the hearing device insertable into the auditory canal, comprising:

providing a vent through the ear mold;

providing an opening through the outer ear of the user from the front to the rear of the outer ear;

connecting the vent to the opening in the outer ear; and ventilating the auditory canal with air guided through the outer ear directly from the rear of the outer ear.

4. The method as claimed in claim 3, wherein a titanium ring encloses the vent opening.

5. The method as claimed in claim 4, wherein the titanium ring projects from the surface of the ear mold.

* * * * *